United States Patent [19]

Waddington et al.

[11] 4,174,147

[45] Nov. 13, 1979

[54] CIRCUIT PANEL CONNECTOR

[75] Inventors: William T. Waddington, Fanwood; Charles F. Mazzeo, Scotch Plains, both of N.J.

[73] Assignee: Amerace Corporation, New York, N.Y.

[21] Appl. No.: 844,728

[22] Filed: Oct. 25, 1977

Related U.S. Application Data

[63] Continuation-in-part of Ser. No. 773,188, Mar. 1, 1977, abandoned.

[51] Int. Cl.[2] ..... H01R 13/12

[52] U.S. Cl. ..... 339/176 MP; 339/64 M

[58] Field of Search ..... 339/64 R, 64 M, 176 M, 339/176 MP, 176 MF, 242, 246, 263 R, 263 L, 269, 271, 272 R, 272 A

[56] References Cited

U.S. PATENT DOCUMENTS

| | | | |
|---|---|---|---|
| 2,161,266 | 6/1939 | Weiger | 339/271 |
| 2,666,189 | 1/1954 | Cook | 339/263 R |
| 2,687,517 | 8/1954 | Despard | 339/263 R |
| 3,047,831 | 7/1962 | Majewski | 339/176 MP |
| 3,657,683 | 4/1972 | Grieshaber | 339/246 |
| 3,930,706 | 1/1976 | Obuch et al. | 339/64 M |

FOREIGN PATENT DOCUMENTS

| | | | |
|---|---|---|---|
| 1498649 | 9/1967 | France | 339/176 MP |

*Primary Examiner*—Gerald A. Dost

*Attorney, Agent, or Firm*—Richard A. Craig; Arthur Jacob

[57] ABSTRACT

A circuit panel connector for enabling the connection of a plurality of circuit terminals at the edge of a circuit panel, such as a printed circuit board, with external conductors includes a unitary block of dielectric material with an elongate slot and self-aligning unitary electrical contact members each having opposed tines for receiving the edge of the circuit panel and a terminal portion with a platform and a clamping screw for selectively securing an external conductor to the electrical contact member.

6 Claims, 16 Drawing Figures

CIRCUIT PANEL CONNECTOR

This application is a continuation-in-part of application Ser. No. 773,188, filed Mar. 1, 1977, now abandoned.

The present invention relates generally to electrical connectors and pertains, more specifically, to electrical connectors of the type which serve as an interface between a circuit panel, such as a printed circuit board, and external conductors.

The increasing use of modular construction in electric and electronic devices and, in particular, the use of pre-wired circuit panels, such as printed circuit boards, in modular construction has led to a demand for electrical connectors capable of making ready electrical connections between such panels and external conductors. Thus, for example, printed circuit boards frequently are constructed with a plurality of circuit terminals located adjacent one edge of the board. That edge is then placed within a connector in the form of a terminal block having contacts which engage the terminals of the printed circuit. External conductors are affixed to the terminal block for electrical connection to the terminals of the printed circuit through the terminal block.

Terminal blocks of the type having contacts which enable ready connection and disconnection of external conductors to various circuits have been in use for quite some time. In such terminal blocks, means are provided, usually in the form of a clamping screw, for selectively clamping or releasing an external conductor to connect or disconnect the conductor and the contact of the terminal block. Such means have been employed in connectors which enable the selective connection of external conductors to printed circuit boards; however, existing connectors of that type do not appear to take into account some of the critical factors in successfully accommodating a complete circuit panel, such as a printed circuit board, within a single connector and a plurality of separate external conductors which individually can be selectively connected to or disconnected from the connector.

One connector which does take into account many of the critical factors in accommodating a complete circuit panel within a single connector and a plurality of separate external conductors is shown in U.S. Pat. No. 3,930,706. In the circuit panel connector described in that patent, the circuit panel enters the connector at a right angle to the external conductors and bifurcated contacts are allowed to slide relative to tubular connector elements in response to entry of the edge of a circuit panel between the tines of the bifurcated contacts. The bifurcated contacts and the tubular connector elements are separate pieces assembled within a body of dielectric material, which is itself assembled of separate parts.

It is an object of the present invention to provide a connector which enables the selective insertion or removal of a circuit panel, such as a printed circuit board, into or out of the connector and enables the selective connection or disconnection of external conductors to or from the connector, with the circuit panel and the external conductors entering the connector from opposite faces of the connector, i.e., 180° from one another.

Another object of the invention is to provide a connector of the type described and in which the body of the connector is economically fabricated in a unitary block of dielectric material.

Still another object of the invention is to provide a connector of the type described in which bifurcated contacts receive the edge of the circuit panel and align themselves within the connector in response to reception of the panel edge in the connector, the bifurcated contacts being unitary with a terminal portion in a contact member readily assembled with the unitary block of the connector.

A further object of the invention is to provide a connector of the type described in which the external conductors may be secured to the contact members in the block by clamping screws which clamp the conductors against corresponding platforms of terminal portions of the contact members. The platforms may be angled to ease access to the clamping screws in certain installations and the unitary block of dielectric material alternately may receive contacts having platforms at different angles.

A still further object of the invention is to provide a connector of the type described which may be mounted selectively in different orientations to accommodate the requirements of a particular installation.

Another object of the invention is to provide a connector which is relatively simple in construction, utilizing components compatible with conventional circuit elements, and is capable of economical manufacture in large numbers and of varied sizes.

The above objects, as well as still further objects and advantages, are attained by the present invention which may be described briefly as a circuit panel connector for enabling connection of the circuit terminals along the edge of a circuit panel, such as a printed circuit board, with external conductors, the panel connector comprising a unitary block of dielectric material having a base, a front, a back opposite to the front, and opposite sides, an elongate socket in the block extending between the opposite sides thereof and open at the front thereof for receiving the panel edge, a number of recesses extending from the back toward the front of the block and spaced from one another between the opposite sides, a like number of openings extending from the front toward the back of the block, each opening communicating with the socket and with a corresponding recess, each opening being aligned along a straight line with a recess such that each opening and its corresponding recess establish a cavity passing through the block from front to back thereof, each cavity having upper and lower walls, a plurality of electrical contact members, each received within a recess of the block, the contact members each including upper and lower tines juxtaposed, respectively, with the upper and lower walls of the corresponding cavity and extending parallel to the straight line into the socket, a strap portion unitary with the tines, a selective terminal portion having a platform unitary with the strap portion and a clamping screw threaded into the platform for selective movement toward and away from the platform for selectively connecting and disconnecting the external conductor and terminal portion with the external conductor entering the respective recess from the back toward the front of the block, means securing the contact members in the block against movement along the straight line, the relative dimensions of the cavity, between the upper and lower walls thereof, and the contact members, in the upward and downward direction, being such that clearance is provided between the contact members and the block for enabling limited upward and downward movement of each contact member relative to the block in response to movement of the panel edge along the straight line into the socket and entry of the panel edge between the upper and lower tines to align the contact members relative to the panel edge.

The invention will be more fully understood, while still further objects and advantages will become apparent, in the following detailed description of preferred embodiments of the invention illustrated in the accompanying drawing, in which FIG. 1 is a partially exploded, partially broken away, perspective view illustrating a connector constructed in accordance with the invention, about to receive a circuit panel and an external conductor;

Figure 1:
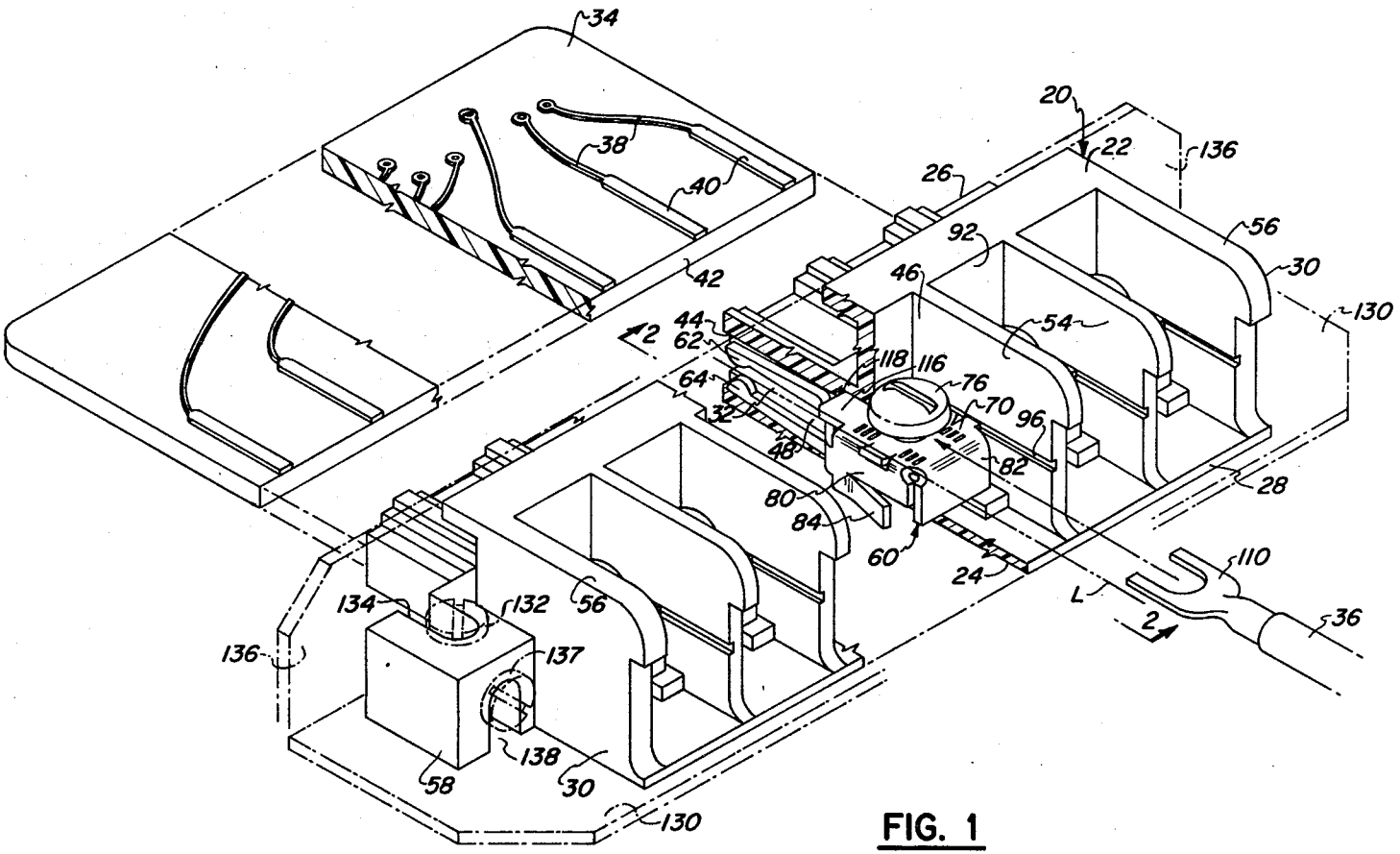

Referring now to the drawing, and especially to FIG. 1 thereof, a connector constructed in accordance with the invention is illustrated at 20 and is seen to include a unitary block 22 of dielectric material having a base 24, a front 26, a back 28 opposite to the front 26 and opposite sides 30. An elongate socket 32 in the block 22 extends in a longitudinal direction along almost the entire length of the block 22 between the opposite sides 30 and is open at the front 26. Connector 20 is to be employed as an interface device to connect a circuit panel, shown in the form of a printed circuit board 34, to a plurality of external conductors, one of which is shown at 36. More specifically, the printed circuit board 34 carries circuitry 38 which includes a plurality of terminals 40 located along a line adjacent one edge 42 of the printed circuit board 34 and each of these terminals 40 is to be connected to a corresponding conductor 36 via the connector 20. While printed circuit board 34 is illustrated with circuitry 38 and terminals 40 on one side only of the board, in some instances terminals will be placed on both sides of the board, along edge 42.

Figure 2:
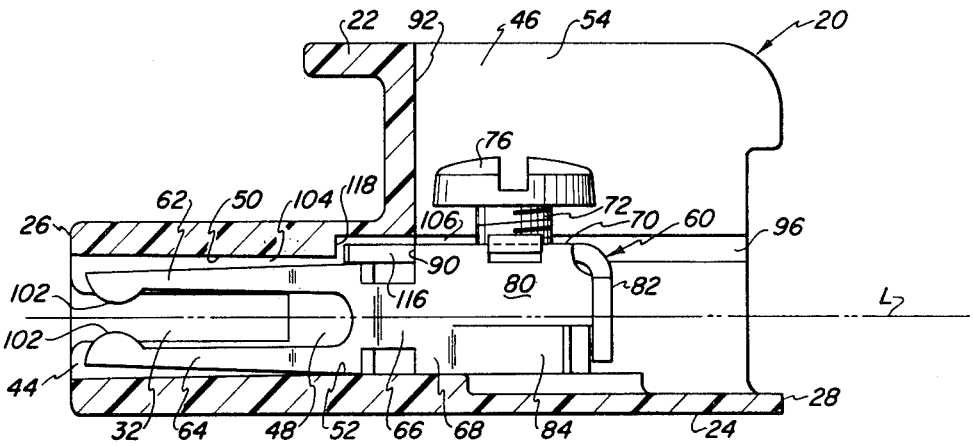
FIG. 2 is an enlarged lateral cross-sectional view taken along line 2—2 of FIG. 1.
Figure 3:
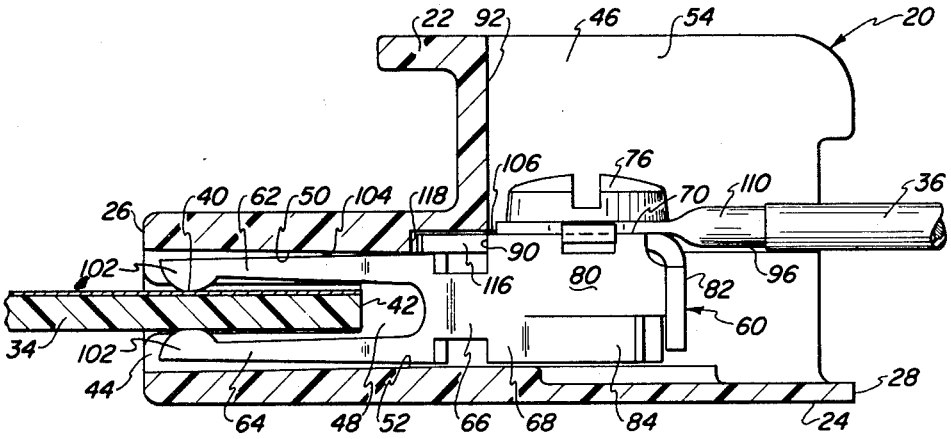
FIG. 3 is a cross-sectional view similar to FIG. 2, but with the circuit panel and external conductor received in the connector.

Turning now to FIGS. 2 and 3, as well as to FIG. 1, socket 32 is generally complementary to the edge 42 of printed circuit board 34 and communicates with a plurality of openings 44 extending from the front 26 toward the back 28 of the block 22. A plurality of recesses 46, equal in number to the number of openings 44, extend from the back 28 toward the front 26 of the block 22, each recess 46 being aligned with a corresponding opening 44 along a straight line L extending from front to back of the block. Each opening 44 communicates with an aligned recess 46 to establish a cavity 48 passing through the block 22 from front to back thereof. Cavity 48 has an upper wall 50 and a lower wall 52. Recesses 46 are spaced laterally from one another, leaving a barrier 54 placed between adjacent recesses 46. Side walls 56 provide barriers at the sides 30 of block 22 and mounts 58 extend from the side walls 56, for purposes which will be explained more fully hereinafter.

A plurality of electrical contact members 60 are received in block 22, one within each recess 46. Each contact member 60 includes a bifurcated front end having an upper tine 62 juxtaposed with upper wall 50 of cavity 48 and a lower tine 64 juxtaposed with lower wall 52. Tines 62 and 64 are parallel to one another and extend parallel to line L into opening 44 so as to be in position to receive the edge 42 of printed circuit board 34 between the tines. A strap portion 66 of each contact member 60 is unitary with tines 62 and 64 and a selective terminal portion 68 of the contact member 60 includes a platform 70 which is unitary with the strap portion 66. A clamping element is shown in the form of a clamping screw 72 threaded into a threaded aperture 74 in the platform and carrying a clamping head 76.

Figure 4:
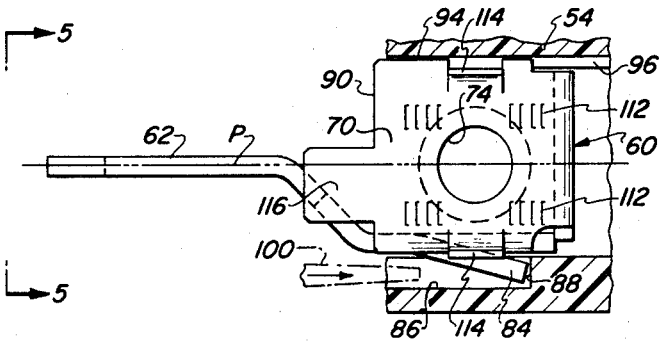
FIG. 4 is a top plan view of an electrical contact member of the connector.
Figure 5:
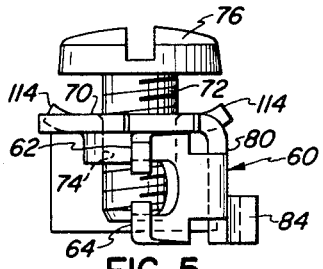
FIG. 5 is a front elevational view of the electrical contact member taken in the direction of arrows 5—5 in FIG. 4.

Each contact member 60 is assembled readily with block 22 by sliding the unitary contact member 60 from the back 28 toward the front 26 of the block, inserting the tines 62 and 64 through cavity 48 into opening 44 and locating the terminal portion 68 in recess 46, as shown in FIGS. 1 through 3. As best seen in FIGS. 4 and 5, as well as in FIGS. 1 through 3, terminal portion 68 in a unitary structure which includes a side wall 80 and a rear wall 82, both depending from platform 70. Tines 62 and 64 are unitary with strap portion 66 which itself is unitary with side wall 80. A tongue 84 is struck from side wall 80 and projects outwardly therefrom. As contact member 60 is inserted into block 22, tongue 84 is resiliently deflected inwardly by adjacent barrier 54 until the contact member is located appropriately within the block. At that point, tongue 84 is permitted to move outwardly into an undercut 86 in the block 22 so as to preclude retraction of the contact member 60 by virtue of the abutment of tongue 84 with a shoulder 88 in the block 22. Further forward movement of contact member 60, along the direction of line L, is precluded by the abutment of the front edge 90 of platform 70 with block 22 at the front surface 92 of recess 46. Thus, each contact member 60 is effectively captured in block 22. It is noted that the appropriate alignment of contact member 60 while moving forward during assembly with block 22 is facilitated by the reception of a side edge 94 of platform 70 within a guide groove 96 in corresponding barrier 54. An inserted contact member 60 may be removed selectively from block 22 merely by inserting a tool into the undercut 86, as seen in phantom at 100 in FIG. 4, to depress tongue 84 until the tongue can clear shoulder 88 while at the same time withdrawing contact member 60 toward the back 28 of block 22.

Tines 62 and 64 carry opposite contact lobes 102 which extend into socket 32. Upon insertion of the edge 42 of circuit board 34 into socket 32, the lobes 102 will make contact with the circuit board 34 and the terminals 40 of circuitry 38 on the circuit board. In those instances where terminals are placed on both sides of the circuit board 34, both lobes 102 will make contact with a terminal. The configuration of the tines 62 and 64 and the strap portion 66 which carries the tines enables the tines to flex and allows the contact lobes 102 to exert an appropriate contact force upon the terminals 40. In order to maintain optimum contact pressure, the tines and strap portion are allowed to move upwardly or downwardly, as a whole, relative to the block 22, so as to align the contact members 60 relative to the circuit board edge 42 in response to movement of the circuit board edge into socket 32.

Thus, the relative dimensions of the contact member 60, in the upward and downward directions, and the cavity 48, between the upper and lower walls 50 and 52, respectively, are such that clearance is provided for upward and downward movement of contact member 60 relative to block 22. As best seen in FIG. 2, a clearance space 104 is shown between the contact member 60 and the upper wall 50 of cavity 48. Likewise, a clearance space 106 is shown between the guide groove 96 and the side edge 94 of the platform 70 of contact member 60. Clearance spaces 104 and 106 are the result of the relative dimensions of the contact member 60 and the complementary portions of the block 22. Upon insertion of circuit board edge 42 into socket 32, as seen in FIG. 3, self-alignment occurs by virtue of the upward movement of the contact member 60 into the clearance spaces 104 and 106. In this manner, the total deflection available between the tines 62 and 64 is distributed equally between the tines and the deflection of each tine can be limited to resilient elastic deflection. The combined effect of the movement of each contact member 60 to align the contact member with the edge of the printed circuit board, together with the equal deflection of both tines provides optimum contact pressure between the contact lobes 102 and any printed circuit board which can be inserted into socket 32.

Conductors 36 are connected electrically to terminals 40 of the printed circuit board 34 by clamping each conductor 36 to the platform 70 of a contact member 60. As seen in FIGS. 1 and 3, conductors 36 may include a connector element 110 at the terminus of the conductor, and the connector element 110 is then secured between the clamping head 76 of clamping screw 72 and platform 70. Where a connector element 110 is not present, the conductor 36 itself is clamped to the platform 70. As best seen in FIGS. 4 and 5, platform 70 is generally planar and includes serrations 112 for strengthening the grip upon a conductor and tangs 114 struck upwardly from the platform to aid in holding the conductor under the clamping head 76 of the clamping screw 72, against forces tending to squeeze the conductor laterally outwardly from beneath the clamping head 76.

During the connection of conductors 36 to contact members 60, clamping forces are generated by applying a torque to the clamping head 76 of the clamping screw 72. In order to resist twisting of the contact member as a result of such torque, terminal portion 68 is provided with a tab 116 extending forward from the platform 70 and entering a complementary slot 118 which communicates with recess 46. The tab 116 and slot 118 arrangement effectively precludes turning of the contact member 60 in response to clamping torque.

Figure 6:
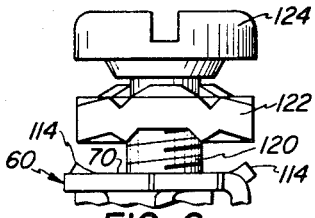
FIG. 6 is a fragmentary front elevational view of the electrical contact member with an alternate clamping screw.

In the embodiment illustrated in FIG. 6, an alternate clamping screw 120 is illustrated. A clamping plate 122 is placed between the clamping head 124 and the platform 70. The use of a clamping plate 122 is preferred where a connection is to be made directly between a conductor and contact member 60, without the use of a connector element, such as connector element 110.

In order to facilitate a visual determination of which conductor 36 will be connected to a particular terminal 40 of the printed circuit board 34, the tines 62 and 64 of each contact member 60 are aligned with the clamping screw 72 (or 120) in such a way that the tines lie in a plane P (see FIG. 4) passing through the centerline of the clamping screw. Thus, tines 62 and 64 are offset from side wall 80 of the contact member 60. In this manner, each conductor 36 will be aligned with a corresponding terminal 40, with the conductor and terminal at opposite faces of the connector, and the alignment can be observed visually.

In use, connector 20 is secured to a mounting plate which is a part of the equipment in which the connector is installed. Connector 20 may be mounted in either of two orientations relative to the mounting plate. Thus, as seen in FIG. 1, base 24 of block 22, which is parallel to line L, may be secured against a mounting plate, shown in phantom at 130, by passing mounting screws 132 through slots 134 in mounts 58. Alternately, block 22 may be secured to an apertured mounting plate, shown in phantom at 136, by passing mounting screws 137 through slots 138 in mounts 58. In either case, the printed circuit board 34 and conductors 36 enter opposite faces of the connector 20 and are aligned parallel to the straight line L.

Connector 20 is economically fabricated. Block 22 is easily molded in a unitary structure, the front to back orientation of the openings 44, recesses 46, the cavities 48 and the mounting slots 134 and 138 enabling the use of a relatively simple mold. Contact members 60 are readily fabricated in one piece and are easily assembled with block 22 to provide an economical assembly.

Turning now to FIGS. 7 through 11, another embodiment of the present invention is illustrated in the form of connector 220. In many respects, connector 220 is similar to connector 20; however, in some installations it becomes necessary to place a plurality of connectors in close proximity to one another and connector 220 takes into account the problems raised in such an installation. For example, it may be desired to install one connector 220 immediately below another upon a mounting plate 221, as illustrated in phantom in FIG. 8, thus enabling only limited access to the terminal portions 268 of the connector members 260 of the connector 220. By modifying the connector components, such an installation becomes more practical.

Connector 220 is seen to include a unitary block 222 offering all of the advantages of block 22 of connector 20 in providing a base 224, a front 226, a back 228 opposite to front 226 and opposite sides 230. An elongate socket 232 receives circuit board 34 for connection to conductors 36.

A plurality of openings 244 and recesses 246 establish cavities 248 each placed along a straight line LL extending from front to back of the block 222. Barriers 254 are placed between recesses 246 and side walls 256 provide barriers at the opposite sides 230. Mounts 258 extend from the side walls 256.

The electrical contact members 260 include tines 262 and 264 which are placed in openings 244, as described in connection with connector 20, the tines being unitary with a strap portion 266 which, in turn, is unitary with terminal portion 268 of the contact member 260. A platform 270 is a unitary part of the terminal portion 268. In this instance, however, platform 270 makes an acute angle A with line LL, as opposed to the parallel arrangement of platform 70 and line L of connector 20, so that the platform 270 faces not only upwardly but toward the back 228 of the block 222. Preferably, angle A is about 45°, for purposes which will be explained more fully hereinafter. A clamping screw 272 is threaded into threaded aperture 274 and carries a clamping head 276 with a clamping plate 277 for making a connection directly to the conductor 36, here shown without a connector element.

Each contact member 260 is assembled readily with block 222 by sliding the contact member 260 from the back 228 toward the front 226 of the block 222. In this instance, a leg 280 is unitary with platform 270 and is turned forward to be received within an aperture 282 in block 222. A tongue 284 is struck outwardly from leg 280 and is resiliently deflected inwardly as the leg 280 is passed through aperture 282. Once through the aperture 282, tongue 284 moves outwardly into undercut 286 to preclude retraction of contact member 260 by abutment with shoulder 288. An inserted contact member 260 may be removed selectively from block 222 by inserting a tool into undercut 286, as seen in phantom at 300 in FIG. 9, to depress tongue 284 until the tongue can clear shoulder 288 while the contact member 260 is withdrawn toward the back 228 of block 222.

Figure 8:
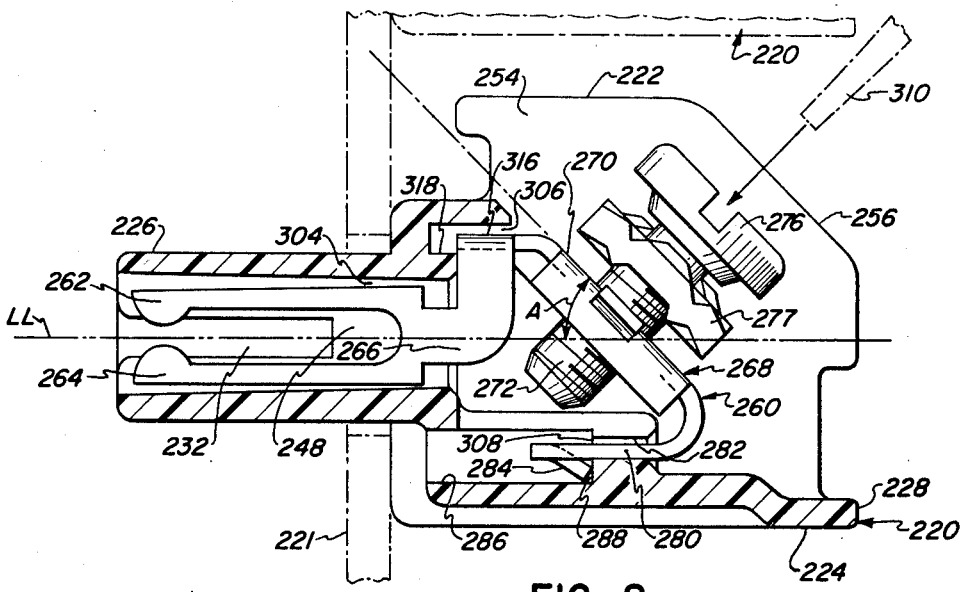
FIG. 8 is an enlarged lateral cross-sectional view taken along line 8—8 of FIG. 7.

As in the earlier-described embodiment, clearance is provided for upward and downward movement of the contact member 260 relative to block 222 for self-alignment of the contact members 260 with the edge 42 of circuit board 34. As best seen in FIG. 8, clearance spaces 304, 306 and 308 allow upward movement of contact member 260 relative to block 222, to the position illustrated in FIG. 9.

Upon connecting a conductor 36 to a contact member 260, a tool, such as a screwdriver 310, is applied to the clamping head 276 of the clamping screw 272. Where connectors 220 are installed in close proximity, as illustrated in FIG. 8, access to the clamping screw 272 is preserved by the angled orientation of platform 270 of the terminal portion 268 of contact member 260. Thus, acute angle A enables the platform 270 to face rearwardly for access from the back 228 so that conductor 36 can be brought to the platform 270 and screwdriver 310 can be applied to the clamping screw 272. In ordinary installations where no second connector is located at the top of the first connector 220, the acute angle A preserves access to the clamping screw 272 from the top of the connector 220, since the platform 270 still faces at least partially upwardly.

As in the earlier described embodiment, clamping torque is resisted by the engagement of a forwardly projecting tab 316 with a complementary slot 318. Tines 262 and 264 are offset relative to the side edges of platform 270 so as to lie in a plane PP passing through the centerline of threaded aperture 274. In this manner, each conductor 36 will be aligned with a corresponding terminal 40 of the printed circuit board 34 to enable visual determination of which conductor 36 will be electrically connected to which terminal 40.

Figure 11:
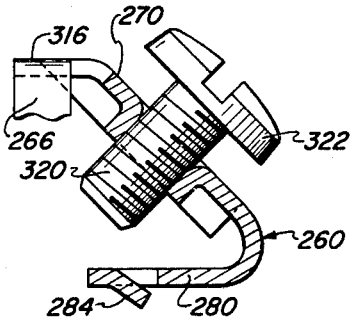
FIG. 11 is a fragmentary cross-sectional view taken along line 11—11 of FIG. 10, with an alternate clamping screw in the contact member.

In the embodiment of FIG. 11, an alternate clamping screw 320 is illustrated. Clamping screw 320 has a clamping head 322, used without a clamping plate, for those instances where conductor 36 includes a connector at the terminus of the conductor.

Figure 7:
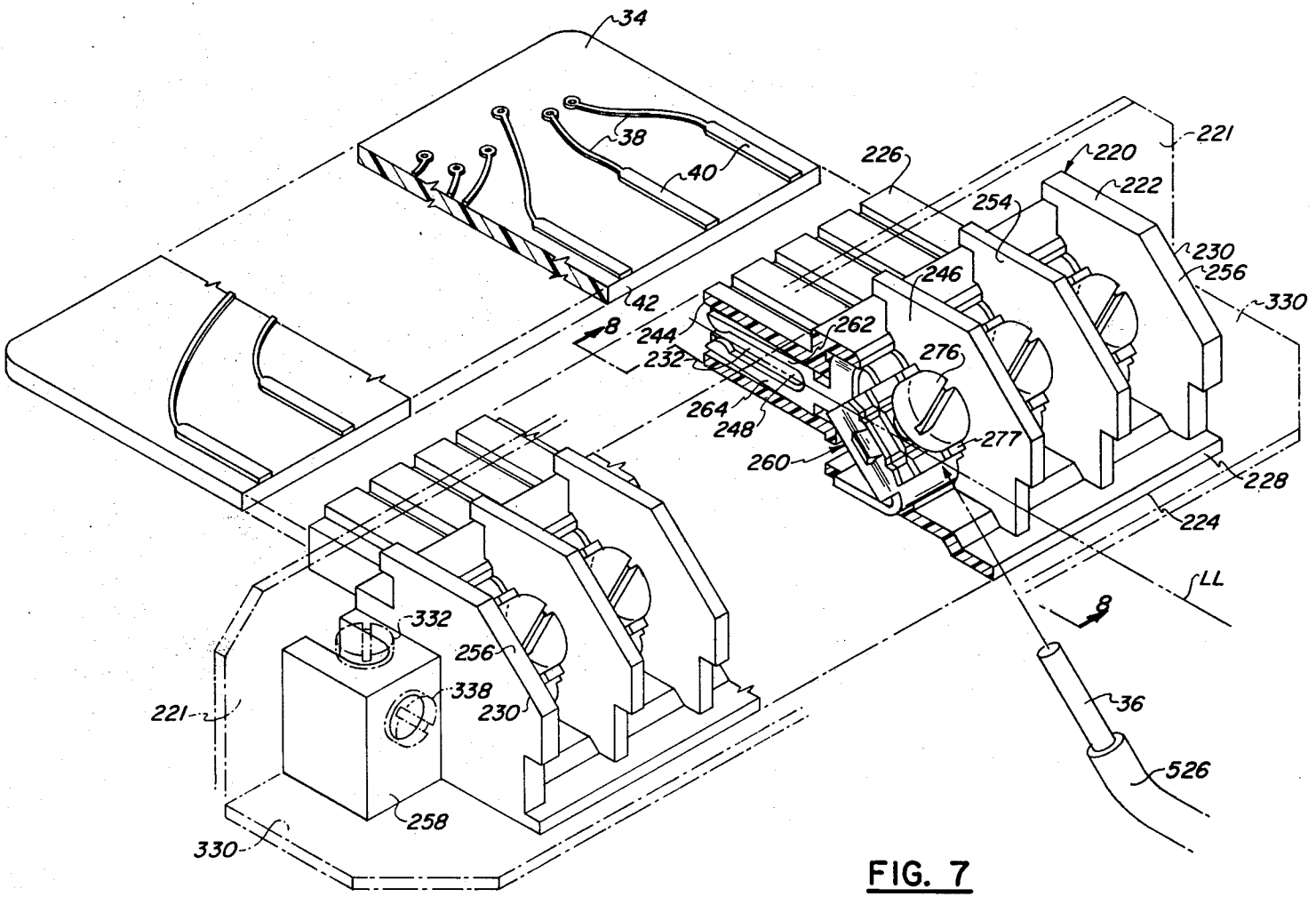
FIG. 7 is a partially exploded, partially broken away, perspective view illustrating another connector constructed in accordance with the invention, about to receive a circuit panel and an external conductor.

In use, connector 220 may be secured to a mounting plate in either of two orientations relative to the mounting plate. Thus, as seen in FIG. 7, base 224 of block 222 is parallel to line LL and may be secured against a mounting plate, seen in phantom at 330, by mounting screws 332. Alternately, block 222 may be secured to an apertured mounting plate, seen in phantom at 221, by mounting screws 338. In either case, the printed circuit board 34 and conductors 36 enter opposite faces of the connector 220 and are aligned parallel to the straight line LL.

Connector 220 is fabricated economically in the same manner as connector 20.

Referring now to FIGS. 12 through 16, a further embodiment of the present invention is illustrated in the form of connector 420. In many respects, connector 420 is similar to connectors 20 and 220; however, connector 420 provides the added advantage of selective interchangeability between contact members of different configurations so that a unitary dielectric block of a single configuration can serve in a wider variety of installations.

Connector 420 is seen to include a unitary block 422 offering all of the advantages of block 22 of connector 20 and block 222 of connector 220 in providing a base 424, a front 426, a back 428 opposite to front 426 and opposite sides 430. An elongate socket 432 receives circuit board 34 for connection to conductors 36 and 37.

A plurality of openings 444 and recesses 446 establish cavities 448 each placed along a straight line LLL extending from front to back of the block 422. Barriers 454 are placed between recesses 446 and side walls 456 provide barriers at the opposite sides 430. Mounts 458 extend from the side walls 456.

The electrical contact members 460 may be chosen from among different types, two different types being illustrated at 460A and 460B. Each contact member 460 includes tines 462 and 464 which are placed in openings 444, as described in connection with connectors 20 and 220, the tines being unitary with a strap portion 466 which, in turn, is unitary with terminal portion 468 of each contact member 460. A platform 470 is a unitary part of the terminal portion 468. Contact member 460A is very similar to contact member 60 in that platform 470 is parallel with line LLL. However, in contact member 460B, platform 470 makes an acute angle A with line LLL, similar to contact member 260. Preferably, angle A is 45°. Thus, depending upon the requirements of a particular installation, either type of electrical contact 460 may be chosen for assembly with block 422. In this manner, manufacture and supply are simplified since block 422 can be manufactured in one standard configuration to serve with either electrical contacts 460A or electrical contacts 460B. A clamping element in the form of a clamping screw 472 is threaded into a threaded aperture 474 in the platform and carries a clamping head 476.

Each contact member 460 is assembled readily with block 422 by sliding the contact member 460 from the back 428 toward the front 426 of the block 422. Terminal portion 468 of each contact member is a unitary structure which includes a side wall 480 and a rear wall 482, both depending from platform 470. Tines 462 and 464 are unitary with strap portion 466 which itself is unitary with side wall 480. A tongue 484 is struck from side wall 480 and secures the contact member against retraction from block 422, as described in connection with connector 20.

It is noted that appropriate alignment of contact members 460A may be facilitated by the reception of a side edge 494A of platform 470 within a guide groove 496 in corresponding barrier 454, as described in connection with connector 20. However, in contact member 460B, side edge 494B makes an acute angle with guide groove 496. Thus, a guide ledge 498 is provided along corresponding barrier 454 and a guide channel 500 is placed along side edge 494B of contact member 460B. The guide ledge 498 is received within the guide channel 500, which is bounded by a tang 502 and a projection 504, so that contact member 460B is positively located and guided into place in block 422. It is further noted that the rear wall 482 of contact member 460A is recessed at 506 to provide clearance for guide ledge 498. As an alternate to guide groove 496 and side edge 494A, a complementary channel (not shown) may be provided at 506 to utilize guide ledge 498 in a manner similar to that illustrated in connection with contact member 460B.

Figure 13:
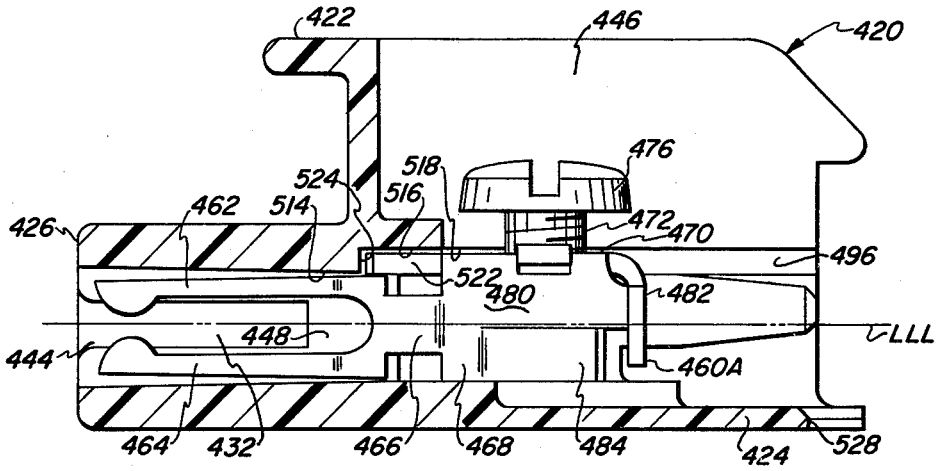
FIG. 13 is an enlarged lateral cross-sectional view taken along line 13—13 of FIG. 12.
Figure 14:
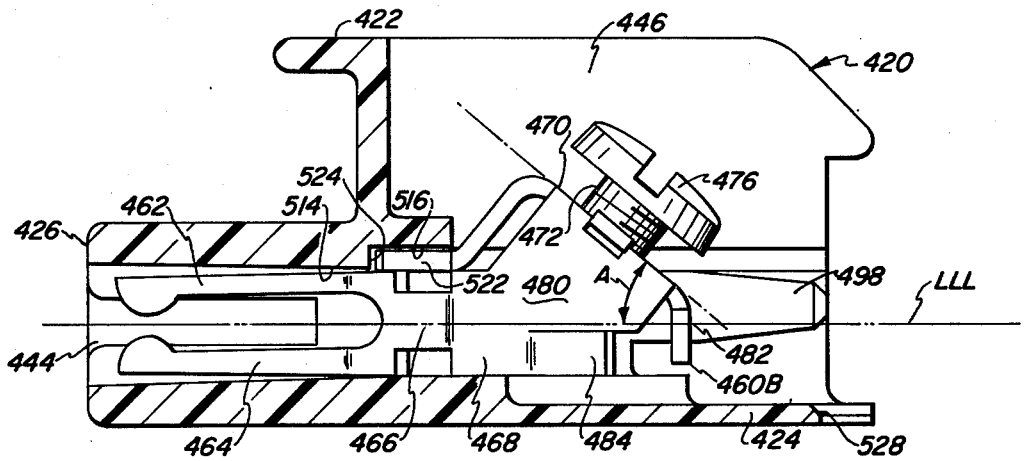
FIG. 14 is an enlarged lateral cross-sectional view taken along line 14—14 of FIG. 12.
Figure 15:
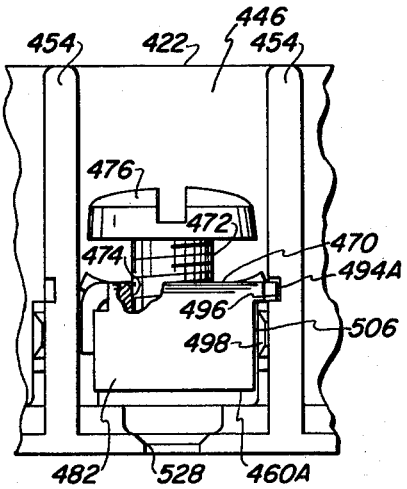
FIG. 15 is a fragmentary rear elevational view taken in the direction of arrow 15 in FIG. 12.
Figure 16:
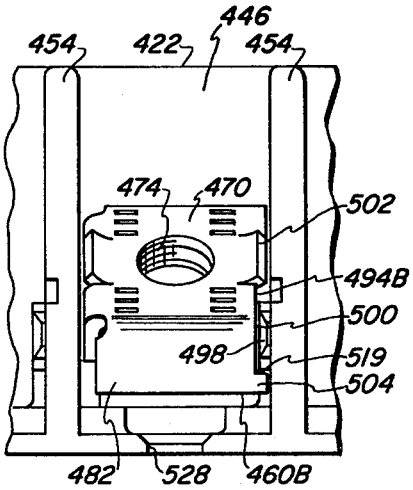
FIG. 16 is a fragmentary rear elevational view taken in the direction of arrow 16 in FIG. 12, with the clamping screw removed.

As in the earlier-described embodiments, clearance is provided for upward and downward movement of the contact members 460 relative to block 422 for self-alignment of the contact members with the edge 42 of circuit board 34. As best seen in FIGS. 13 and 14, clearance spaces 514, 516, 518 and 519 allow upward movement of contact members 460A and 460B relative to block 422.

Upon connecting a conductor 36 or 37 to a respective contact member 460A or 460B, the clamping head 476 of the clamping screw 472 secures the appropriate connector element 520 against a platform 470. Clamping torque is resisted by the engagement of a forwardly-projecting tab 522 within a complementary slot 524. As in earlier-described embodiments, the offset tines 462 and 464 assure that each conductor 36 or 37 will be aligned with a corresponding terminal 40 of the printed circuit board 34 to enable visual determination of which conductor 36 or 37 will be electrically connected to which terminal 40.

Figure 9:
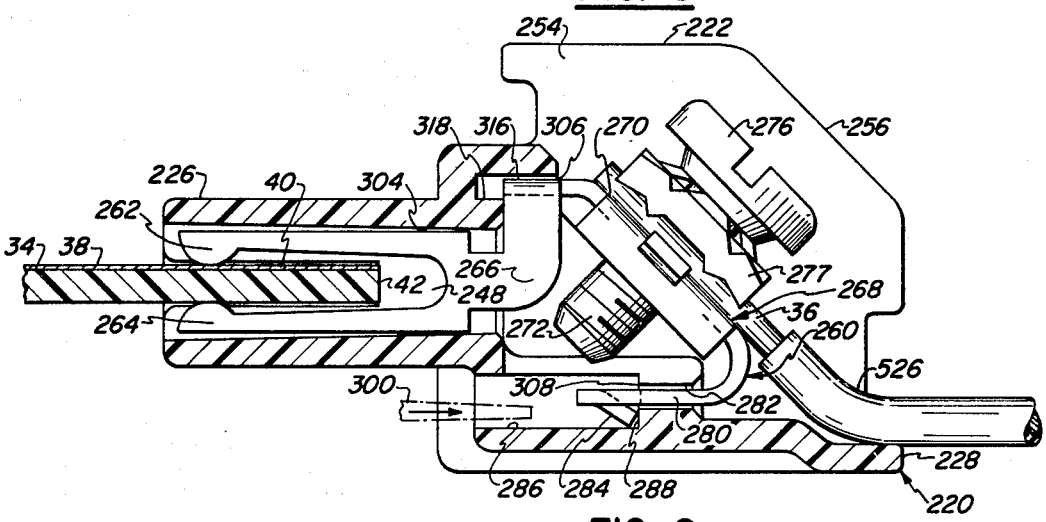
FIG. 9 is a cross-sectional view similar to FIG. 8, but with the circuit panel and external conductor received in the connector.
Figure 10:
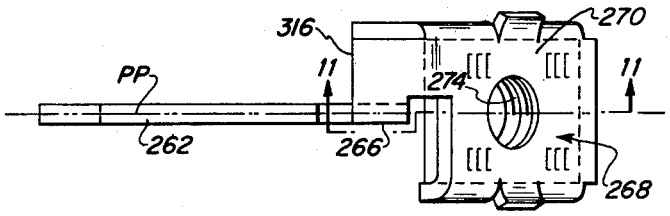
FIG. 10 is a top plan view of an electrical contact member of the connector.

In order to ease access to platform 470 of contact members 460B, and to eliminate a bend in a conductor, as shown at 526 in FIGS. 7 and 9, block 422 is provided with a notch 528 in the base 424 at each recess 446 to accommodate a straight entry of conductor 37 into recess 446 and toward platform 470 of contact member 460B.

Figure 12:
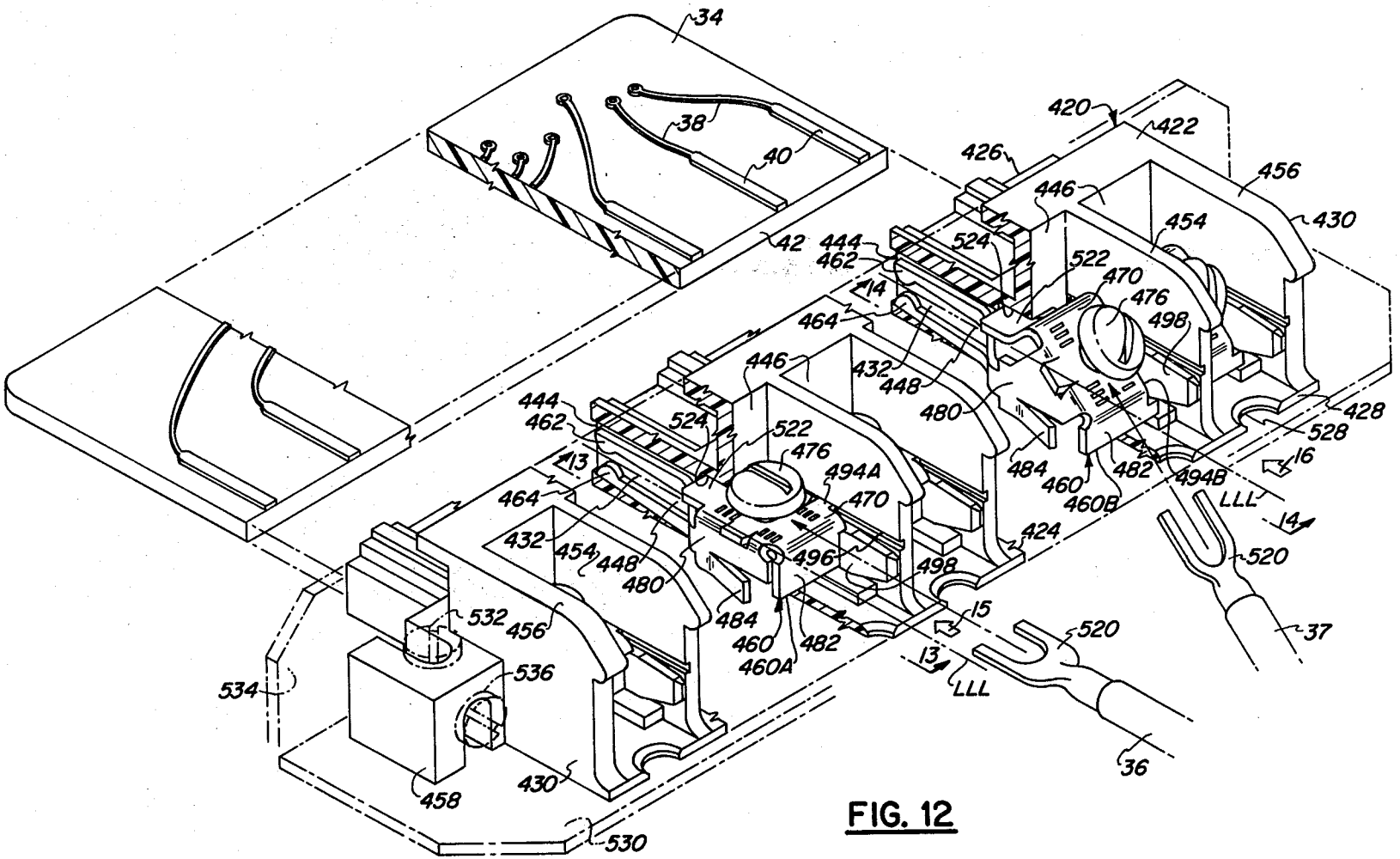
FIG. 12 is a partially exploded, partially broken away, perspective view illustrating still another connector constructed in accordance with the invention, about to receive a circuit panel and external conductors.

In use, connector 420 may be secured to a mounting plate in either of two orientations relative to the mounting plate. Thus, as seen in FIG. 12, base 424 of block 422 is parallel to line LLL and may be secured against a mounting plate, seen in phantom at 530, by mounting screws 532. Alternately, block 422 may be secured to an apertured mounting plate, seen in phantom at 534, by mounting screws 536. In either case, the printed circuit board 34 and conductors 36 and 37 enter opposite faces of the connector 420.

Connector 420 is fabricated economically in the same manner as connectors 20 and 220, but with the added economy of requiring a block 422 of a single configuration for selectively accommodating contact members 460A and 460B of different configurations.

It is to be understood that the above detailed description of embodiments of the invention are provided by way of example only. Various details of design and construction may be modified without departing from the true spirit and scope of the invention as set forth in the appended claims.

The embodiments of the invention in which an exclusive property or privilege is claimed are defined as follows:

1. A circuit panel connector for enabling connection of the circuit terminals along the edge of a circuit panel, such as a printed circuit board, with external conductors, said panel connector comprising:

a unitary block of dielectric material having a base, a front, a back opposite to the front, and opposite sides;

an elongate socket in the block extending between the opposite sides thereof and open at the front thereof for receiving the panel edge;

a number of recesses extending from the back toward the front of the block, a pair of barriers associated with each said recess, one said barrier of each adjacent pair of barriers having guide means in its associated recess;

a like number of openings extending from the front toward the back of the block, each opening communicating with the socket and with a corresponding recess, each opening being aligned along a straight line with a recess such that each opening and its corresponding recess establish a cavity passing through the block from front to back thereof, each cavity having upper and lower walls;

a plurality of electrical contact members, each received within a different recess of the block, the contact members each including upper and lower tines juxtaposed, respectively, with the upper and lower walls of the corresponding cavity and extending parallel to the straight line into the socket, a strap portion unitary with the tines, a selective terminal portion having a platform unitary with the strap portion and a clamping screw threaded into the platform for selective movement toward and away from the platform for selectively connecting and disconnecting the external conductor and the terminal portion with the external conductor entering the respective recess from the back toward the front of the block, each said contact member being of either a first configuration wherein the platform thereof lies in a plane parallel to the straight line and said contact member of said first configuration interengages and is located and guided by a portion of said guide means or a second configuration wherein the platform thereof lies in a plane making an acute angle with the straight line, with the platform thereof facing upwardly and toward the back of the block and said contact member of said second configuration interengages and is located and guided by a different portion of said guide means; and means securing the contact members in the block against movement along the straight line.

2. The invention of claim 1 wherein the acute angle is about 45°.

3. The invention of claim 1 wherein the base of the block is parallel to the straight line.

4. The invention of claim 1 wherein the tines of each contact member are aligned in a plane passing through the centerline of its associated clamping screw.

5. The invention of claim 1 wherein:

the contact members each include a tab extending from the platform; and the block includes a slot communicating with each recess for receiving the tab of the contact member in the recess such that the tab engages the slot to resist turning of the terminal portion in response to clamping torque applied to the clamping screw.

6. The invention of claim 1 including a notch in the base of the block at the back thereof, the notch being aligned with the straight line.

* * * * *